US005207447A

United States Patent [19]

Erdei et al.

[11] Patent Number: 5,207,447

[45] Date of Patent: May 4, 1993

[54] SKI BINDING

[75] Inventors: Roland Erdei, Weigelsdorf; Henry Freisinger, Vienna; Heinz Wittmann, Vienna; Johann Zotter, Vienna, all of Austria

[73] Assignee: HTM Sport- und Freizeitgeraete Gesellschaft m.b.H., Schwechat, Austria

[21] Appl. No.: 768,669

[22] PCT Filed: Feb. 8, 1991

[86] PCT No.: PCT/EP91/00240

§ 371 Date: Sep. 30, 1991

§ 102(e) Date: Sep. 30, 1991

[87] PCT Pub. No.: WO91/12058

PCT Pub. Date: Aug. 22, 1991

[30] Foreign Application Priority Data

Feb. 16, 1990 [AT] Austria ..... 368/90

[51] Int. Cl.[5] ..... A63C 9/00

[52] U.S. Cl. ..... 280/617; 280/618; 280/633

[58] Field of Search ..... 280/617, 618, 607, 633, 280/634, 636

[56] References Cited

U.S. PATENT DOCUMENTS 3,790,186 2/1974 Kanno ..... 280/617
5,056,808 10/1991 Klaus et al. ..... 280/617

FOREIGN PATENT DOCUMENTS 2613387 10/1977 Fed. Rep. of Germany ..... 280/617

*Primary Examiner*—Richard M. Camby
*Attorney, Agent, or Firm*—Flynn, Thiel, Boutell & Tanis

[57] ABSTRACT

A ski binding which includes a front jaw and a heel holder and a connecting element connected to and extending between the front jaw and the heel holder. In order to reduce the space needed for packaging the above type of ski binding, the invention provides that the connecting element is composed of first and second parts. The first part has a plastic coating having a recess therein extending in longitudinal direction of the connecting element. The first part also has two bolts with enlarged heads thereon, said bolts being received in keyhole-like recesses provided in the second part associated with the heel holder.

9 Claims, 2 Drawing Sheets

SKI BINDING

FIELD OF THE INVENTION

The invention relates to a ski binding comprising a front jaw and a heel holder and further comprising a connecting element which extends between the front jaw and the heel holder, with the heel holder being arranged at the rear end of the connecting element and being guided for relative slip motion in the mounted state of the ski binding in a guide rail fastened on the ski by means of screws, with the front jaw being fastened in this state by means of screws directly to the upper side of the ski and with the connecting element between the front jaw and the heel holder being provided with a coating of plastic material.

BACKGROUND OF THE INVENTION

Such a ski binding is already known and is described in AT-PS 389 453. Difficulties existed in this ski binding during the mounting and during transport since, due to the one-piece construction of the connecting element, on the one hand, handling of the binding proved to be difficult and, on the other hand, only a voluminous packaging of the ski binding was possible.

Further ski bindings have been suggested in which the connecting element was of a split design (see Technisches Handbuch of Atomic-Ess 1989/90). Of course, the split design of the connecting element had the sole purpose of being able to adjust the binding to different boot sizes. A partial section of this design had for this reason a form of serrated slats, with two bolts, flattened on one side, on the other partial section being able to engage or disengage the serrated slats. Of course, the cover had to be removed in order to adjust the ski binding and had to be replaced after the adjustment. A screwdriver was thereby needed for unlocking and locking of the bolts.

A similar type of a ski binding with a split connecting element is illustrated in FIGS. 7 and 8 of DE-OS 25 54 384. The connecting element consists in this binding of two saw-toothlike serrated belts made of an expansion-resistant material, of which the one is fixedly connected to the front jaw and the other one to the heel holder. The two belts can engage one another in various locked positions and are held together in the engaged position by a snap part.

The purpose of the invention is to provide a ski binding of the above-mentioned type such that the connecting element has a split design, however, that both partial sections can be connected in a simple manner, namely without the aid of a screwdriver.

SUMMARY OF THE INVENTION

The objects and purposes of the invention are met by providing a ski binding which includes a front jaw and a heel holder connected by a connecting element. The heel holder is arranged at the rear end of the connecting element whereas the front jaw is arranged at the front end of the connecting element. The heel holder is mounted for relative movement with respect to the ski in a guide rail fastened on the ski. The front jaw is mounted to the ski. The connecting element is comprised of first and second partial sections, the first partial section being connected to the front jaw and has a recess extending in a longitudinal direction of the connecting element. The second partial section is connected at one end to the heel holder and at the other end is received in the recess. The first partial section associated with the front jaw has at least one bolt with a head thereon, the bolt being located in the recess. The other end of the second partial section having a portion with at least one keyhole-like recess therein, the portion being received in the recess. The keyhole-like recess receives the bolt therein to effect a securement of the first and second partial sections together at a location between the front jaw and the heel holder. A stop device is provided in the recess and extends transversely of the longitudinal direction of the connecting element. The second partial section has an abutting structure thereon for engaging the stop device so that relative movement of the front jaw and the heel holder toward one another is prevented by one of the bolt and the stop device.

BRIEF DESCRIPTION OF THE DRAWINGS

The drawings illustrate an exemplary embodiment of the subject matter of the invention.

DETAILED DESCRIPTION

Figure 1:
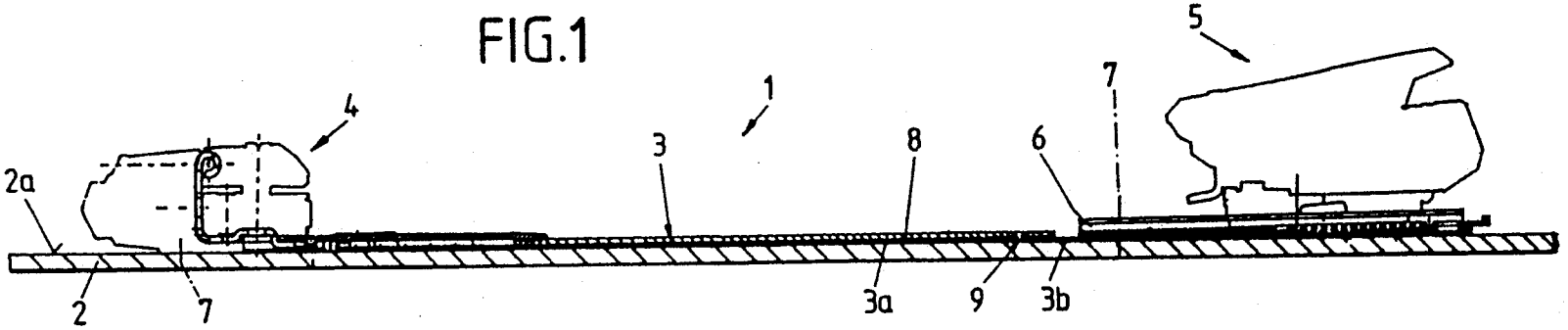
FIG. 1 is a central, vertical longitudinal cross-sectional view of the ski binding of the invention in which the front jaw and the heel holder are only schematically illustrated.
Figure 2:
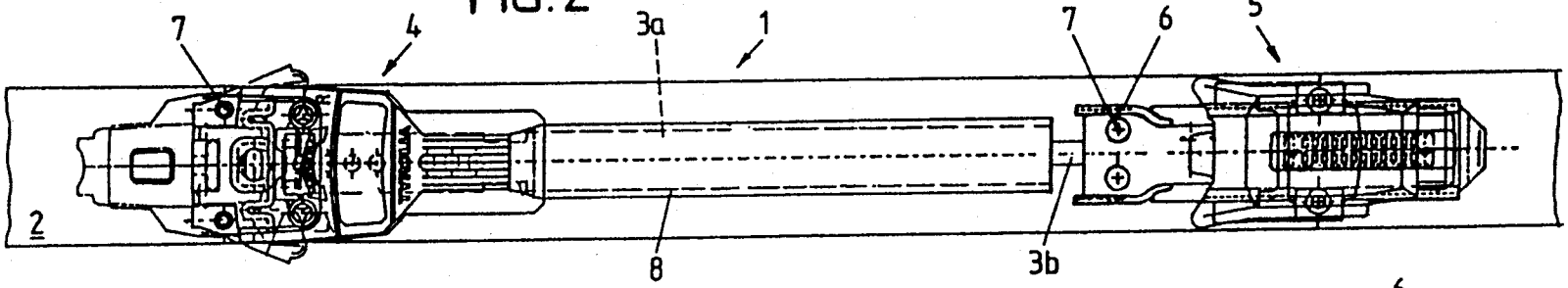
FIG. 2 is a top view of FIG. 1.

A ski binding is identified in its entirety by the reference numeral 1 in FIGS. 1 and 2. The ski binding is fastened to an upper side 2*a* of a ski 2. The ski binding 1 includes a connecting element 3 which is, for example, constructed as a metal band, a front jaw 4 which is fixedly connected to the connecting element 3, and a heel holder 5 which is guided in a longitudinal direction of the ski in a ski-fixed guide rail 6 and prevented from lifting off the ski, and which in order to adjust to various boot sizes can be locked with the connecting element 3 in different positions. The front jaw 4 and the guide rail 6 are fastened by means of screws 7 to the upper side 2*a* of the ski 2.

The connecting element 3 consists of two partial sections 3*a* and 3*b*, of which the one partial section 3*a* carries the front jaw 4 and the other partial section 3*b* carries the heel holder 5. The connecting element 3 has a coating 8 in the area of the first partial section 3*a*. The first partial section 3*a* carrying the front jaw 4 has on the underside in its coating 8 a recess 8*a* extending in the longitudinal direction of the ski, in which recess 8*a* the free end area of the second partial section 3*b* carrying the heel holder 5 can be fixed. The first partial section 3*a* carries for this purpose two downwardly projecting bolts 9 equipped with heads 9*a*. Whereas the second partial section 3*b* has three keyhole-like recesses 10, the tapered partial areas 10*b* of which are directed toward the free end of the partial section 3*b*.

Reference numeral 10*a* identifies the wider partial area of the individual recesses 10. Furthermore, the depth of the recess 8*a* is greater or equal to the length of the bolts 9. Thus, a rubbing of the heads 9*a* of the bolts 9 on the upper side 2*a* of the ski is avoided.

The second partial section 3*b* is, during installation, mounted with the wider partial areas 10*a* of two of the keyhole-like recesses 10 onto the two bolts 9 and is thereafter moved in longitudinal direction of the connecting element 3 until the two bolts 9 rest with their shanks 9*b* at the ends of the tapered partial areas 10*b* of the two recesses 10. The free end of the second partial section 3*b* rests thereby against a stop surface 8*b* of the coating 8, which stop surface 8*b* extends transversely with respect to the longitudinal direction of the connecting element 3. This is made easier by the second partial section 3*b* being constructed elastically in an elevational direction. As soon as the desired position of the second partial section 3*b* relative to the first partial section 3*a* has been reached, the second partial section 3*b* snaps into the recess 8*a* of the coating 8, and the two partial sections 3*a* and 3*b* are fixed nonmovably with respect to one another.

Figure 4:
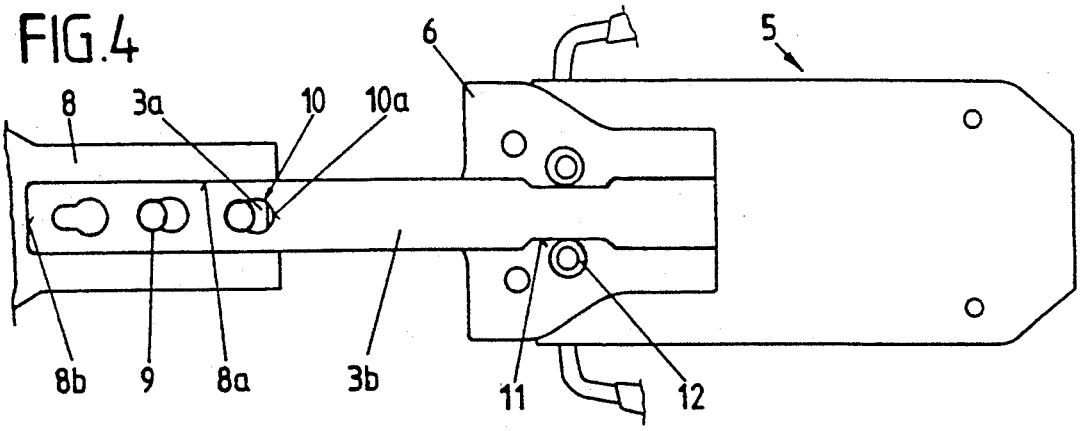
FIG. 4 is a bottom view of a part of the connecting element in the assembled state.
Figure 5:
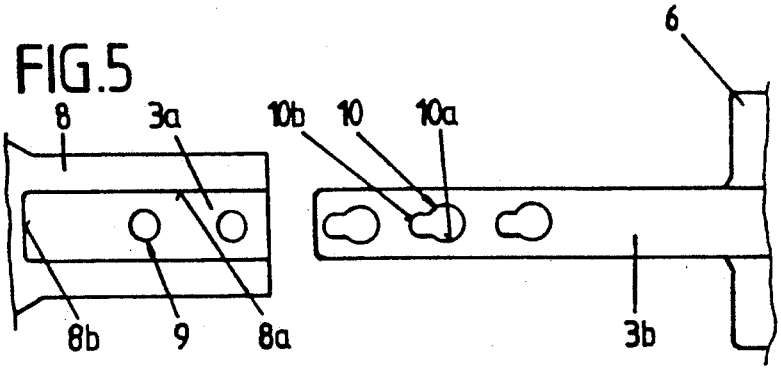

As can be seen from FIGS. 4 and 5, the two front keyhole-like recesses 10 could also receive therein the two bolts 9. In order to also fix in this case the two partial sections 3*a* and 3*b* nonmovably with respect to one another, two coatings 8 with differently long recesses 8*a* having the stop surface 8*b* are provided for the first partial section 3*a* of the connecting element 3, which recesses correspond with the respective chosen locked positions and are selectively used.

The second partial section 3*b* of the connecting element 3, which section 3*b* carries the heel holder, is tapered in its area 11 extending below the guide rail 6 and is guided for limited movement in longitudinal direction of the ski between two stampings 12 receiving the screws 7.

Figure 6:
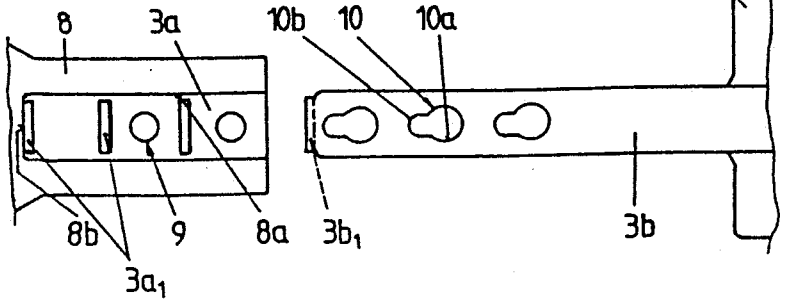
FIG. 5 in a pulled apart state and FIG. 6 is a pulled apart state of a modified form of the connecting element. The last-mentioned figures are also shown in an enlarged scale.
Figure 3:
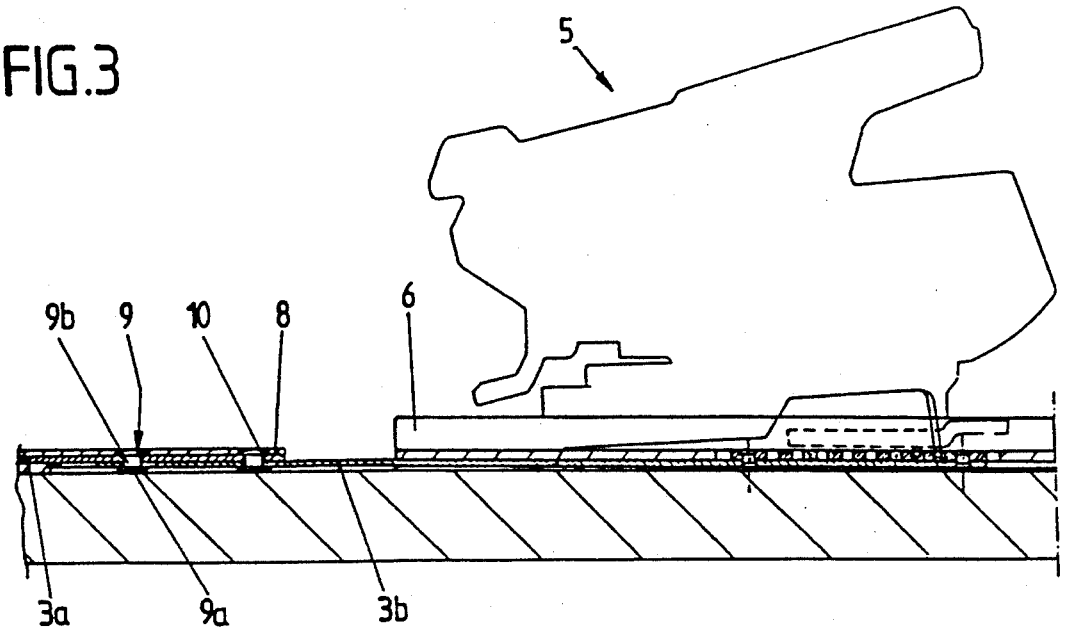
FIG. 3 shows in an enlarged scale a detail of FIG. 1 in the central, vertical longitudinal cross section.

The invention is not to be limited to the above-described exemplary embodiment illustrated in the drawings. Rather various modifications of the same are possible without departing from the scope of the invention. It is, for example, conceivable to provide the second partial section carrying the heel holder with a bend at its free end, such as the bend $3b_1$ shown in FIG. 6. The bend in the mounted state of the connecting element is received in a slot 3*a* in the first partial section $3a_1$ carrying the front jaw, which slots 3*a* extends in a transverse direction.

The embodiments of the invention in which an exclusive property or privilege is claimed are defined as follows:

1. In a ski binding comprising a front jaw and a heel holder and a connecting element which extends between the front jaw and the heel holder, the heel holder being arranged at a rear end of the connecting element and the front jaw being arranged at a front end of the connecting element, the heel holder in the mounted state of the ski binding being guided with slip motion in a guide rail fastened on the ski by means of screws, the front jaw being in the mounted state fastened by means of screws directly to an upper side of the ski, and the connecting element being provided with a coating of plastic material between the front jaw and the heel holder, the improvement wherein the connecting element is comprised of first and second partial sections, wherein the first partial section is connected to the front jaw and has a recess extending in a longitudinal direction of the connecting element, wherein the second partial section is connected at one end to the heel holder and at the other end is received in the recess, the first partial section associated with the front jaw having at least one bolt with a head thereon, said bolt being located in the recess, the other end of the second partial section having a portion with at least one keyhole-like recess therein, said portion being received in said recess, said at least one keyhole-like recess receiving said at least one bolt therein to effect a securement of said first and second partial sections together at a location between the front jaw and the heel holder, and wherein a stop means is provided in said recess and extends transversely of the longitudinal direction of the connecting element, said second partial section having abutting means thereon for engaging said stop means so that relative movement of said front jaw and said heel holder toward one another is prevented by one of said at least one bolt and said stop means.

2. The ski binding according to claim 1, wherein said bolt has a shank of a first diameter extending between a bottom wall of said recess and a head of a second diameter larger than said first diameter, wherein said keyhole-like recess includes a wide recess through which said head is received and an interconnected narrow recess corresponding in width to said first diameter, said shank being received in said narrow recess so that said head is on a side of said second partial section remote from said bottom wall when said abutting means and said stop means are engaged.

3. The ski binding according to claim 2, wherein said second partial section of said connecting element is resiliently flexible in an elevational direction.

4. The ski binding according to claim 1, wherein a depth of said recess in said coating is at least one of greater than and equal to a length of said bolts.

5. The ski binding according to claim 1, wherein three keyhole-like recesses are provided and are spaced at equal distances from one another in said second partial section of said connecting element, and wherein on said first partial section of said connecting element there is selectively provided one of two coatings, the stop surface of which corresponds with the respectively chosen locking position.

6. The ski binding according to claim 1, wherein said second partial section of said connecting element is tapered in a region that extends below said guide rail and is guided for limited movement in longitudinal direction of the ski relative to said heel holder between two stampings on said heel holder.

7. The ski binding according to claim 1, wherein said abutting means on said second partial section includes a bend at its free end, wherein said stop means is defined by at least one slot in said first partial section, said slot extending transversely of the longitudinal direction of said connecting element.

8. The ski binding according to claim 1, wherein said stop means includes a plurality of slots spaced from one another, the distances between said slots corresponding with the distances between said recesses in said second partial section.

9. The ski binding according to claim 1, wherein said stop means is defined by a wall surface on said coating which defines a wall of said recess.

* * * * *